United States Patent [19]

Pearson

[11] 4,027,629

[45] June 7, 1977

[54] LIVESTOCK SQUEEZE CHUTE

[75] Inventor: Laurence B. Pearson, Thedford, Nebr.

[73] Assignee: Pearson's, Inc., Thedford, Nebr.

[22] Filed: June 30, 1975

[21] Appl. No.: 591,488

[52] U.S. Cl. ..... 119/99; 119/98

[51] Int. Cl.[2] ..... A61D 3/00

[58] Field of Search ..... 119/99, 98, 20, 147, 119/150, 27; 403/353, 348, 246, 168, 116, 52

[56] References Cited

UNITED STATES PATENTS

| | | | |
|---|---|---|---|
| 2,593,559 | 4/1952 | Heldenbrand | 119/99 |
| 2,650,567 | 9/1953 | Whitworth | 119/99 |
| 2,773,476 | 12/1956 | Thomas | 119/99 |
| 2,851,993 | 9/1958 | Hettinger | 119/99 |
| 3,683,864 | 8/1972 | Priefert | 119/99 |

FOREIGN PATENTS OR APPLICATIONS

| | | | |
|---|---|---|---|
| 285,240 | 3/1966 | Australia | 119/99 |
| 212,175 | 1/1958 | Australia | 119/98 |

*Primary Examiner*—Louis G. Mancene
*Assistant Examiner*—Peter K. Skiff
*Attorney, Agent, or Firm*—Kokjer Lowe

[57] ABSTRACT

A livestock squeeze chute includes upright sides mounted on the frame by parallelogram supports that permit movement of the sides toward and away from one another while always maintaining the sides parallel. The sides are coupled together for opposite equidistant movement by arms that extend from the respective sides and connect to a common shaft at the forward end of the chute. A hand lever is provided to rotate the shaft and effect movement of the sides toward and away from one another. A ratchet lock mechanism acts automatically to retain the sides against outward movement. A release is selectively operable to release the ratchet lock mechanism. The sides include panels and bar sections which are removable to provide access to the entire body of an animal in the chute.

3 Claims, 8 Drawing Figures

LIVESTOCK SQUEEZE CHUTE

BACKGROUND AND SUMMARY OF THE INVENTION

This invention relates generally to the handling of livestock and deals more particularly with a squeeze chute for immobilizing an animal in a standing position to permit various operations to be performed on the animal.

Existing squeeze chutes typically provide sides that pivot inwardly about their bottom ends in order to squeeze livestock. Since the distance between the sides at the bottom must conform substantially to the width of the animal, this type of chute requires adjustment in the spacing of the sides if both large and small animals are to be handled. It is also difficult for animals to enter or be driven into the chute because its width at the bottom is barely sufficient to accommodate the animal. In addition, the manner in which the sides pivot tends to shock or excite the animal and often causes a loss of balance. The construction of the sides of existing squeeze chutes presents a further problem in that the sides obstruct access to much of the animal's body, making examination and other operations on the animal difficult.

It is one of the important objects of the present invention to provide an improved livestock squeeze chute which includes upright sides that remain parallel at all times and are moved equidistantly toward one another to squeeze the animal equally from each side. A significant feature of the invention in this regard is the provision of unique parallelogram supports which mount and retain the sides parallel to one another so as not to unduly shock the animal or knock it off balance.

Another important object of the invention is to provide a squeeze chute which is able to accommodate the largest to the smallest animal without requiring structural changes or adjustments, and which is wide enough at the entry to easily receive even the largest animal. Significantly, the width of the chute as the animal enters is uniform throughout its height and is not restrictively narrow at the bottom or elsewhere so as to discourage the animal from entering.

Yet another object of the invention is to provide a squeeze chute which includes an automatically acting lock which firmly holds the sides against the animal despite any escape efforts, along with an easily operated release mechanism for the lock.

A further object of the invention is to provide a squeeze chute in which both the squeeze and release can be fully operated easily and rapidly by a single man from either side of the chute.

An additionally object of the invention is to provide a squeeze chute having easily removable panels and bar sections on the sides to facilitate access to the entire body of the animal.

A still further object of the invention is to provide a squeeze chute of the character described which is constructed ruggedly yet economically, which may be operated quickly and easily to efficiently handle livestock, and which requires minimal maintenance.

Other and further objects of the invention, together with the features of novelty appurtenant thereto will appear in the course of the following description.

DETAILED DESCRIPTION OF THE INVENTION

In the accompanying drawings which form a part of the specification and are to be read in conjunction therewith, and in which like reference numerals are employed to indicate like parts in the various views.

Figure 1:
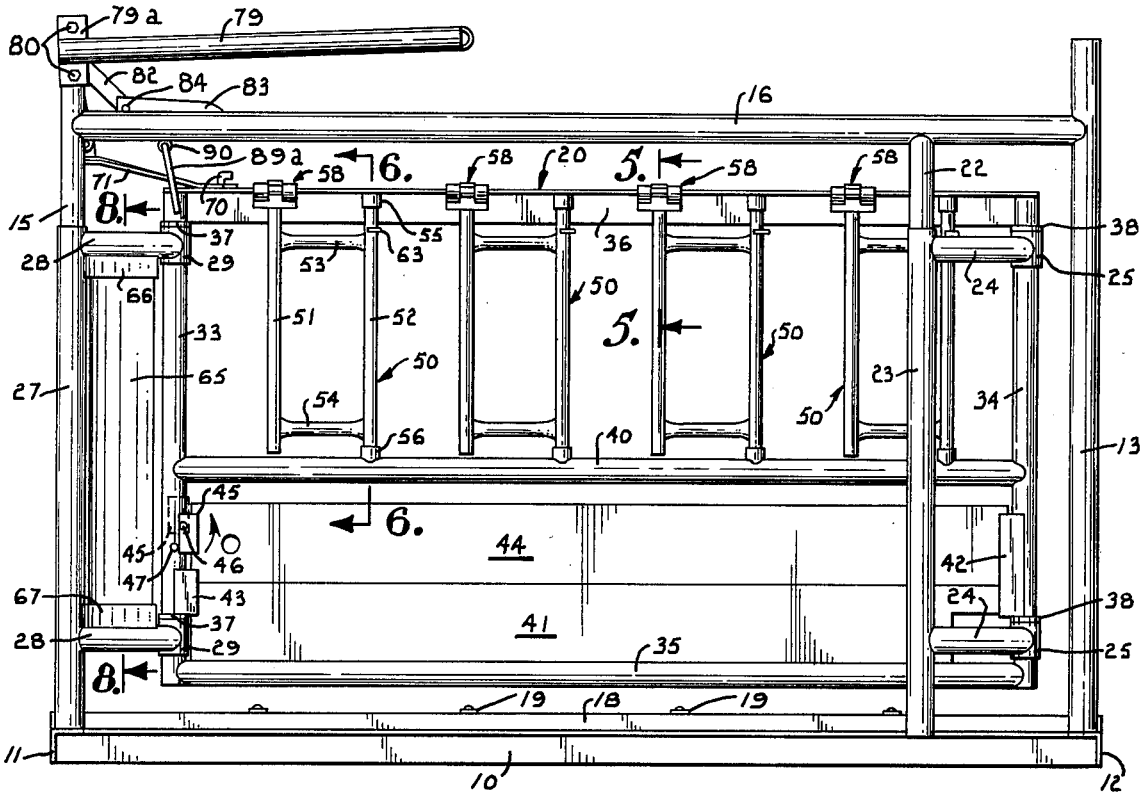
FIG. 1 is a side elevational view of a livestock squeeze chute constructed in accordance with a preferred embodiment of the invention, with the movable sides positioned at their maximum spacing from one another and the broken lines illustrating movement of the pivotal latch for the side panels to its release position to permit removal of the side panels.
Figure 6:
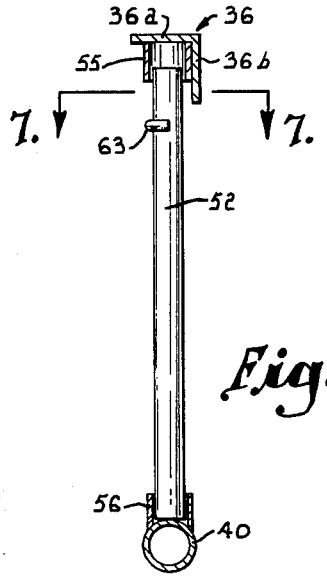
FIG. 6 is a fragmentary sectional view on an enlarged scale taken generally along line 6—6 of FIG. 1 in the direction of the arrows.
Figure 7:
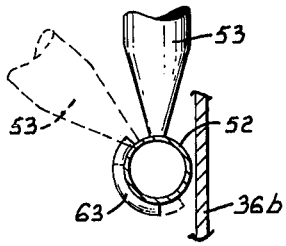
Figure 8:
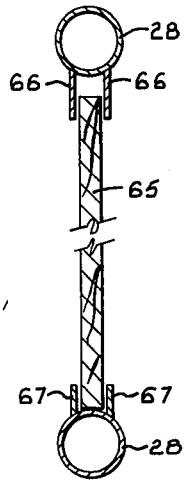

FIG. 7 is a fragmentary sectional view on an enlarged scale taken generally along line 7—7 of FIG. 6 in the direction of the arrows, with the broken lines illustrating movement of the bar section to a rotative position wherein its removal is permitted; and FIG. 8 is a fragmentary sectional view on an enlarged scale taken generally along line 8—8 of FIG. 1 in the direction of the arrows, the broken away portion of the panel indicating continuous length.

Figure 2:
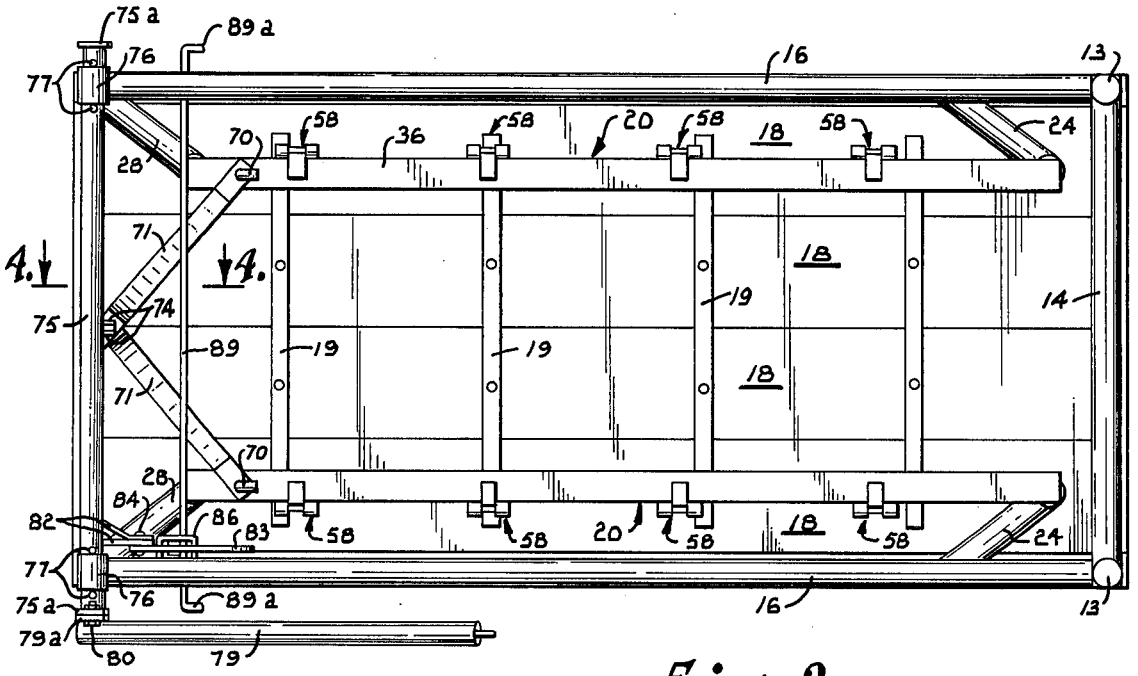
FIG. 2 is a top plan view of the squeeze chute shown in FIG. 1, with the sides positioned at their maximum spacing from one another.

Referring now to the drawings and initially to FIGS. 1 and 2, the rigid frame of the squeeze chute includes a pair of horizontal lower side frame members 10 which are parallel to one another on opposite sides of the chute. A front angle section 11 is welded to interconnect members 10 at their forward ends, and a rear angle section 12 interconnects the rearward ends of members 10. Angle sections 11 and 12 cooperate with the lower side frame members 10 to provide a rigid rectangular base frame on which the squeeze chute is supported.

A pair of upright cylindrical posts 13 are welded to extend upwardly from the opposite ends of rear angle section 12. These rearward posts 13 are parallel and are spaced laterally apart to form the inlet end of the chute. A horizontal cross member 14 (FIG. 2) is welded to extend between the top ends of posts 13. A barred gate (not shown) of conventional construction is hinged to swing about one of the posts 13 to open and close the inlet end of the chute.

The outlet end of the chute is formed by a pair of upright posts 15 which are welded to the opposite ends of the forward angle section 11. Each forward post 15 is connected to the corresponding rearward post 13 by a horizontal structural member 16 which extends between the posts somewhat below their top ends. A head gate (not shown) is mounted between posts 15 at the outlet end of the chute. Although the head gate forms no part of the present invention, it may be of the type disclosed in U.S. Pat. No. 3,221,707, which is incorporated by reference to set forth an example of a head gate that is suitable for use with the invention.

The floor of the chute comprises four floor panels 18 which are secured edge to edge by metal cross strips 19 bolted to the floor panels. The floor is supported at its opposite ends on top of the front and rear angle sections 11 and 12. The width of the floor is less than the distance between the forward posts 15 or the rearward posts 13, and the side edges of the floor are therefore located inwardly somewhat from posts 13 and 15.

The opposite sides of the squeeze chute are generally designated by reference numeral 20 and are supported on the frame for movement toward and away from one another. Each side 20 is mounted on a parallelogram support which permits the side to swing inwardly and outwardly (as well as forwardly and rearwardly somewhat), while the sides are always maintained parallel to one another regardless of their positions. The structural and mounting details of only one side 20 will be described, it being understood that the opposite side is constructed and mounted in the same manner.

With reference to FIG. 1, a cylindrical post 22 extends vertically between each lower side member 10 and the structural member 16 located thereabove. Post 22 is spaced forwardly from rear post 13. An elongate tubular member 23 is sleeved over post 22 and rests on member 10. The inside diameter of tubular member 23 is sufficiently large to permit it to rotate about the vertical axis of post 22. A pair of upper and lower horizontal arms 24 are welded to extend inwardly and rearwardly from tubular member 23 near its top and bottom ends, respectively. Arms 24 are equal in length and are parallel to one another. Each arm 24 carries a cylindrical sleeve 25 on its end, the sleeves being vertically aligned with one another.

Each forward post 15 similarly receives an elongate tubular member 27 which is of sufficient inside diameter to rotate about the vertical axis of the post. Parallel upper and lower arms 28 of equal length extend horizontally from tubular member 27 at elevations corresponding to arms 24. Arms 28 are parallel to arms 24, and each arm 28 carries a cylindrical sleeve 29, on its end, the two sleeves 29 being in vertical alignment.

Each side 20 is rectangular and includes an upright forward post 33 and an upright rear post 34 which are rigidly interconnected at their bottom ends by a horizontal structural member 35 and at their top ends by an elongate horizontal angle section 36. The forward post 33 is cylindrical and is fitted through sleeves 29, the sleeves being sufficiently large in inside diameter to rotate about the vertical axis of post 33. A pair of enlarged collars 37 are welded to post 33 and rest on top of sleeves 29 to retain the forward end of side 20 in its proper vertical position, with member 35 spaced somewhat above the floor. In a similar manner, sleeves 25 surround the rear post 34 and are rotatable about the vertical axis thereof. Collars 38 welded to post 34 rest on sleeves 25 to retain the rearward end of side 20 in position. Sides 20 are thus mounted uprightly, and the sides are able to swing toward and away from one another on arms 24 and 28, as well as forwardly and rearwardly somewhat. As best illustrated in FIG. 2, side 20, structural member 16, and arms 24 and 28 cooperate to form a parallelogram configuration when viewed in plan, and the parallelogram arrangement maintains sides 20 parallel to the respective structural members 16 as the sides move. Accordingly, sides 20 always remain parallel with the longitudinal axis of the chute and with one another. In addition, the sides are equidistant from the longitudinal center line of the chute.

With continued reference to FIG. 1, each side 20 includes an intermediate structural member 40 which extends horizontally between posts 33 and 34 at a location slightly below center on the posts. A lower side panel 41 is supported on top of member 35 to extend between posts 33 and 34. The top portion of the rearward edge of panel 41 is retained in a bracket 42 comprising spaced plates welded to post 34, while a pair of plates welded to post 33 provide a bracket 43 which receives the top portion of the forward edge of panel 41. The lower rearward portion of panel 41 is cut away to avoid interfering with the movement of arm 24. An upper side panel 44 rests on top of panel 41 with its top edge spaced below member 40. Substantially the entire rearward edge of panel 44 is received in bracket 42, while bracket 43 receives the lower portion of the forward edge of panel 44.

A latch 45 in the form of a plate pivoted to post 33 by a pin 46 cooperates with brackets 42 and 43 in retaining side panels 41 and 44 in place. Pivot pin 46 is offset above center and on the left side of latch 45 such that the weight of the latch normally retains its lower left edge in engagement with a stop 47 on post 33, as shown in solid lines in FIG. 1. In this latching position, the latch bears against the surface of the upper panel 44 to retain the panel in place. However, the upper panel is free of latch 45 when the latch is pivoted counterclockwise about the off center pin 46 to the broken line position of FIG. 1. Panel 44 may then be raised sufficiently to clear it of bracket 43 and permit it to be angled in order to be removed from the rear bracket 42. The lower panel 41 may then be raised to clear bracket 43 and then angled sufficiently to permit removal from rear bracket 42. The panels may be reinserted in brackets 42 and 43 and retained therein by movement of latch 45 back to its latching position. Each panel is preferably provided with an opening such as that indicated at 48 in panel 44 to facilitate the lifting and lowering of the panels.

Four identical bar sections, generally indicated at 50, are mounted to extend vertically between intermediate member 40 and angle section 36 at spaced positions on each side 20. Each bar section 50 comprises a pair of spaced vertical bars 51 and 52 which are interconnected by horizontal bars 53 and 54 below their top ends and above their bottom ends. Each bar 52 is of cylindrical shape so that its top end rotatably fits within a sleeve 55 which is welded to the underside of angle 36. The bottom end of each bar 52 is received for rotative movement in a sleeve 56 which is welded to the top side of member 40 and which is of lesser height than sleeve 55.

Figure 5:
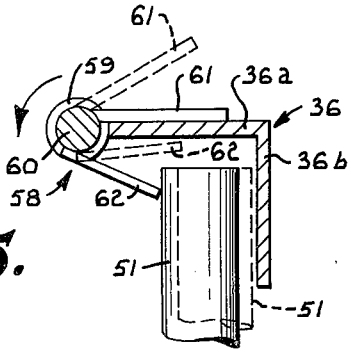
FIG. 5 is a fragmentary sectional view on an enlarged scale taken generally along line 5—5 of FIG. 1 in the direction of the arrows, with the broken lines illustrating movement of the latch for one of the bar sections to its release position to release the bar section.

Each bar 51 is normally retained adjcent to the vertical flange of angle 36 by a latch member 58. With particular reference to FIG. 5, each latch 58 includes aligned hinge barrels 59 which are welded to the outer edge of the horizontal flange **36*a* of angle 36. A horizontal hinge pin 60 is received for pivotal movement in barrels 59, and a pair of small plate members 61 and 62 extend outwardly from the shaft of pin 60 between the hinge barrels. Plate 61 overlies flange 36*a*, while plate 62 is located below flange 36*a* and is oriented at an angle of approximately 30° with respect to plate 61. The lower plate 62** is weighted to normally urge the latch toward the latching position shown in solid lines in FIG. 5. In this position, plate 61 rests on top of flange 36*a*, and the edge of plate 62 confronts bar 51 to prevent the bar from swinging outwardly. However, when bar 51 is positioned against the vertical flange 36*b* of angle 36, as shown in broken lines in FIG. 5, latch 58 can be pivoted upwardly to the broken line position of FIG. 5 to release bar 51 and permit bar section 50 to be swung outwardly about the axis of bar 52.

Referring now to FIG. 6, each bar 52 rests on member 40 within sleeve 56, while a clearance distance greater than the height of sleeve 56 is provided within sleeve 55 between the top end of bar 52 and flange 36*a*. An arcuate projection or bead 63 is formed on the surface of each bar 52 to prevent the bar from being lifted and removed from sleeve 56 unless it is moved to a particular rotative position in the sleeve. Bead 63 extends through an arc less than 180° on bar 52 and is located below the bottom edge of the vertical flange 36*b* of angle 36 of distance less than the height of sleeve 56.

To remove bar section 50, latch 58 is pivoted upwardly to release bar 51 and permit the bar section to be swung outwardly about bar 52 until bar 51 has barely cleared the edge of the horizontal flange 36*a* of angle 36. This is the position shown in broken line in FIG. 7, and it is noted that bead 63 has not been moved beneath the vertical flange 36*b*. Consequently, bar 52 may be lifted without interference from the bead until it clears sleeve 56, at which time the bar can be angled sufficiently to permit its removal from sleeve 55. If bar 52 is pivoted counterclockwise beyond the broken line position of FIG. 7, bead 63 will move beneath flange 36*b* and will engage the bottom edge thereof before bar 52 has been raised sufficiently to clear sleeve 56. Each bar section 50 must therefore be moved to a preselected rotative position (broken line position of FIG. 7) in order to permit its removal from side 20.

The bar sections may be reinstalled by holding them in the appropriate position wherein the top end of bar 52 may be inserted in sleeve 55 without interference from bead 63. After the bar has fully entered sleeve 55, its bottom end will have been raised sufficiently to permit it to enter sleeve 56. Bar section 50 is then swung inwardly about bar 52, and bar 51 pushes plate 62 upwardly upon engagement therewith. Once bar 51 has cleared the edge of plate 62, the weight of plate 62 will automatically return latch 58 to its latching position in which the bar section is firmly retained in place on side 20.

A removable panel 65 is supported between the upper and lower arms 28 on each side of the chute in the area in which the neck of an animal will be located. With reference to FIG. 8 in particular, a pair of spaced plates 66 are welded to the underside of the upper arm 28 to provide an upper bracket. A lower bracket is provided by spaced plates 67 which are welded to the top of the lower arm 28 and which are of lesser height than plates 66. Neck panel 65 rests on top of lower arm 28 between plates 67 with its top edge received between plates 66 but below upper arm 28 a distance greater than the height of plates 67. The panel may be removed by raising it within plate 66 until its bottom edge has been raised above plates 67. The panel may then be removed from the lower bracket and angled sufficiently to permit its removal from the upper bracket. Of course, panel 65 may be reinstalled by reversing the above steps.

Figure 4:
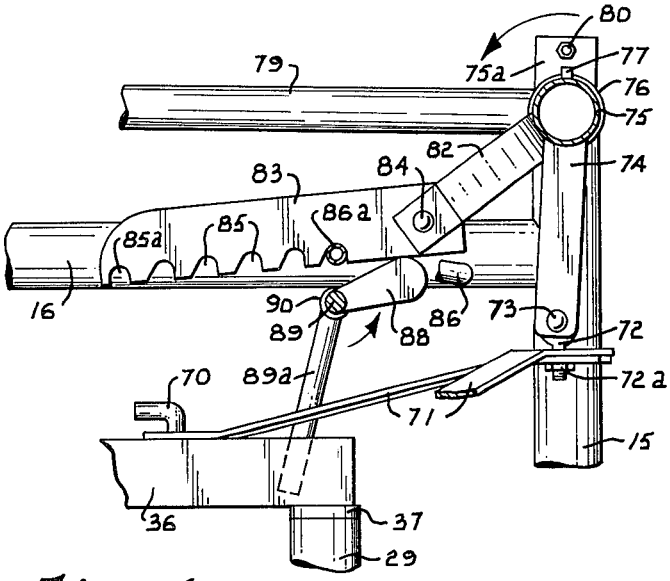
FIG. 4 is a fragmentary sectional view on an enlarged scale taken generally along line 4—4 of FIG. 2 in the direction of the arrows.

The opposite sides 20 are coupled together such that their movement toward and away from one another is equal but opposite. With reference to FIG. 4, the upper angle section 36 on each side has an L-shaped member 70 extending upwardly therefrom. Members 70 provide pivot connections between sides 20 and respective pivot arms 71 which are equal in length. The flat rearward end of each arm 71 is apertured, and the apertures are fitted over the respective members 70 with the rearward ends of the arms normally resting flatly on top of angles 36. The apertures in arms 71 are large enough to permit the arms to pivot about the vertical axes of members 70, while the upper horizontal legs of members 70 are spaced above angles 36 sufficiently to permit limited upward and downward movement of the arms on the upstanding vertical legs of the L-shaped members. As arms 71 extend forwardly they converge toward one another and also extend slightly upwardly. The flat forward ends of the arms overlie one another in horizontal planes and are pivoted together by a vertical pivot bolt 72 secured by a nut 72*a*. The bolt has an enlarged circular head which is oriented vertically and is spaced above nut 72*a* sufficiently to permit the forward ends of arms 71 to move upwardly and downwardly on the bolt shank. The enlarged head of bolt 72 is pivoted by a horizontal pivot coupling 73 between the lower ends of a pair of bracket plates 74 which are welded to extend below a horizontal shaft 75 at a central location on the shaft. A sleeve 76 is welded to the top end of each forward post 15 to provide rotative support for shaft 75. The shaft is fitted through sleeves 76 and is able to rotate therein, while shaft 75 has projections 77 located on each side of both of the sleeves 76 to prevent the shaft from sliding horizontally in the sleeves.

Figure 3:
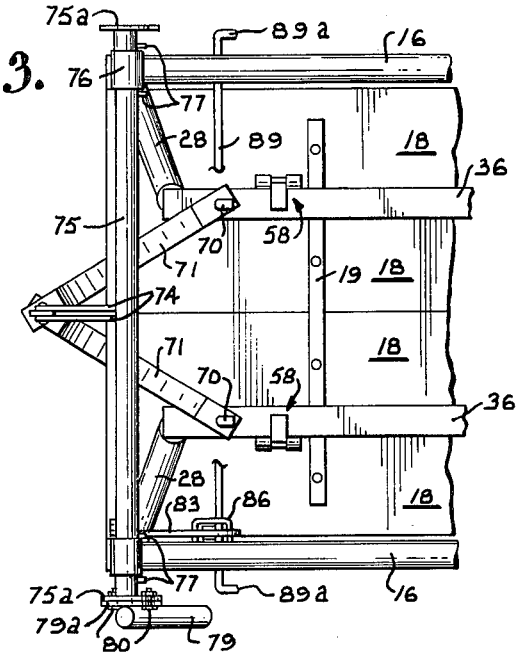
FIG. 3 is a fragmentary top plan view similar to FIG. 2, but showing the sides moved inwardly and positioned at their minimum spacing from one another.

It is pointed out that the pivot coupling 73 which connects bolt 72 to plates 74 is offset below shaft 75, and that counterclockwise rotation of the shaft from the FIG. 4 position will therefore carry the forward ends of arms 71 forwardly, as well as slightly upwardly. As a result, the rearward ends of arms 71 are pulled equal distances inwardly and forwardly, and the opposite sides 20 are thus moved forwardly and inwardly equal distances from the position shown in FIG. 2 toward the position shown in FIG. 3.

A crank arm in the form of an elongate lever 79 is accessible from the side of the chute to effect rotation of shaft 75. Rectangular flanges 75*a* are welded on each end of shaft 75. One end of lever 79 has a mating flange 79*a* which is rigidly bolted against flange 75*a* on either end of shaft 75 by bolts 80. It is significant to note that lever 79 can be secured to either end of shaft 75 by removing bolts 80 and rebolting flange 79*a* to the flange 75*a* on the opposite end of the shaft. Accordingly, lever 79 can be operated from whichever side of the chute is desired. Lever 79 is preferably horizontal when sides 20 are spaced apart in the position of FIG. 2 so that the lever can be pulled downwardly to swing the sides inwardly toward the FIG. 3 position.

A ratchet mechanism for locking the sides in place is best illustrated in FIG. 4. A pair of bracket arms 82 are welded to shaft 75 at a location slightly inwardly of one of the sleeves 76. Arms 82 extend rearwardly and downwardly from the shaft at a considerable angle relative to plates 74. The flat rearward ends of arms 82 lie against one another and are pivoted to the forward end of a ratchet bar 83 by a horizontal pivot coupling 84. Bar 83 extends rearwardly from the pivot coupling such that its weight tends to pivot it downwardly at all times. The lower edge of bar 83 is provided with a plurality of spaced notches 85. The forward edge of each notch 85 extends upwardly into the ratchet bar at a right angle with respect to the lower edge of the bar. The upward or seating portion of each notch is smoothly rounded, and the rearward edge of the notch angles rearwardly as it extends from the seating portion to the lower edge of the bar. The rearward end notch is dessignated 85*a* in FIG. 4 and is of symmetrical configuration, with its forward and rearward edges each extending into bar 83 at right angles with respect to the lower edge of the bar.

A U-shaped rod member 86 is welded to one of the structural members 16 to cooperate with bar 83 in locking the sides in place. Rod 86 is oriented at an angle from horizontal, with its horizontal rearward leg 86*a* raised somewhat above its forward leg. Leg 86*a* is cylindrical and is sized to enter notches 85 and seat in the rounded portions thereof. The configuration of notches 85 permits leg 86*a* to ride out of the notches along the inclined rearward surfaces thereof as bar 83 is carried forwardly in response to counterclockwise rotation of shaft 75 from the FIG. 4 position. However, leg 86*a* is not able to ride out of the notches in the opposite direction, that is when a rearward force is exerted on bar 83, due to the perpendicular orientation of the straight forward edges of the notches. Sides 20 may therefore be moved inwardly toward one another without obstruction from the locking mechanism, while the sides are retained in place by the locking mechanism when an outward force tending to move the sides away from one another is applied. When leg 86*a* is located in the rear end notch 85*a*, sides 20 can not be moved either inwardly or outwardly because of the perpendicular orientation of each edge of notch 85*a*. With continued reference to FIG. 4, a release mechanism includes a cam 88 which acts against bar 83 to separate notches 85 from leg 86*a* when it is desired to move sides 20 away from one another. Cam 88 is mounted on an elongate rod 89 which is supported to rotate in a pair of small sleeves 90 welded to the undersides of the respective structural members 16. Rod 89 is located directly below leg 86*a*, and cam 88 extends forwardly and upwardly from rod 89. The cam has a rounded surface which bears against the lower edge of bar 83 within the U-shaped member 86. Rod 89 extends entirely across the width of the chute, and its opposite ends are turned downwardly at right angles to provide handles 89*a* which are accessible from either side of the chute to rotate the rod.

In operation of the invention, sides 20 are initially set well apart in the position of FIG. 2 to provide sufficient room for even the largest animal to enter the squeeze chute through the open rear gate (not shown). Once the animal has entered the chute, the rear gate is closed and lever 79 is pulled downwardly to move sides 20 progressively toward one another. As previously related, sides 20 move equidistantly and remain parallel so that they squeeze each side of the animal equally. As sides 20 move toward one another to begin squeezing the animal, he will crowd forwardly until he reaches the head gate (not shown) at the forward end of the chute, at which time his head or neck will encounter the head gate and be retained therein. As sides 20 squeeze inwardly, ratchet bar 83 will be pulled forwardly and leg 86*a* will ride in and out of notches 85. When sides 20 have been moved inwardly a distance sufficient to tightly squeeze the animal therebetween, leg 86*a* will be positioned in one of the notches 85, and the sides will be locked against movement away from one another due to the perpendicular orientation of the forward edges of the notches. Sides 20 will therefore immobilize the animal in a standing position, and the animal will not be able to force the sides outwardly despite any escape attempts that he may make. It is noted that ratchet bar 83 may have any desired number of notches 85 and that sides 20 may therefore have any desired number of locked positions between their minimum and maximum spacing from one another.

If the neck or legs of the animal require examination or treatment, neck panel 65 and/or side panels 41 and 44 may be removed to provide ready access on either side to the neck or leg area. Also, any of the bar sections 50 may be removed in the manner previously described in order to permit any portion of the animal's body to be operated upon without obstruction from the bars.

To release the animal, the head gate is released and rod 89 is rotated by means of one of its handles 89*a*. As the rod is rotated counterclockwise from the FIG. 4 position, cam 88 will move upwardly against the lower edge of ratchet bar 83 and will raise the bar sufficiently above leg 86*a* to disengage the notches 85 from leg 86*a*. Lever 79 may then be cranked upwardly without interference from the ratchet mechanism. As 79 is moved upwardly (or clockwise as viewed in FIG. 4) to rotate shaft 75, the forward ends of arms 71 are pushed rearwardly and the rearward ends of the arms are forced outwardly and rearwardly. Consequently, sides 20 move rearwardly and outwardly away from one another from the FIG. 3 position toward the FIG. 2 position. The animal is then free to leave the chute through its forward end, or the animal may be backed out of the chute after the rear gate (not shown) has been opened.

From the foregoing it will be seen that this invention is now well adapted to attain all the ends and objects hereinabove set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. In a livestock squeeze chute having a frame and laterally spaced sides supported on said frame for movement toward and away from one another to squeeze an animal therebetween, the combination therewith of:

a bar section on at least one side, said bar section comprising a pair of spaced apart upright members interconnected by cross members with at least one upright member having an upper end and a lower end, upper and lower coupling means on said one side providing a rotatable coupling for said upper and lower ends thereby to permit swinging movement of said bar section to different angular positions relative to said side, said coupling means arranged to provide for disconnection of said lower end from the lower coupling means in response to upward vertical movement of said one upright member, means associated with said one upright member operable to prevent said upward vertical movement except when said bar section is in a predetermined angular position relative to said side, and releasable latch means associated with the other upright member of said bar section and operable to releasably restrain swinging movement of said bar section to said predetermined angular position.

2. In a livestock squeeze chute having a frame and laterally spaced sides supported on said frame for movement toward and away from one another to squeeze an animal therebetween, the combination therewith of:

a plurality of bar sections for each side comprising interconnected bars, each bar section comprising a pair of upright bars interconnected by cross bars with at least one upright bar having an upper end and lower end;

an upper mounting bracket and a lower mounting bracket for each bar section spaced vertically apart from one another on the respective sides, each pair of upper and lower mounting brackets connected with the respective upper and lower ends of said one upright bar to support the bar section on the sides, said upper bracket of a vertical length sufficiently great to permit the bar section to be raised relative to said lower bracket a sufficient distance to disconnect the lower end of said one upright bar from the lower bracket, thereby permitting removal of said bar sections from said sides, means associated with each said one upright bar and operable to prevent said upward vertical movement except when the bar section is in a predetermined angular position relative to the side on which it is mounted, and releasable latch means associated with the other upright bar of each bar section and operable to releasably restrain movement of the bar section to said predetermined angular position.

3. The combination as set forth in claim 2, wherein said upper and lower mounting brackets comprise sleeves receiving the upper and lower ends of said one upright bar for rotation to permit each bar section to be swung about the axis of its one upright bar, and including means fcr preventing removal of said one upright bar from said sleeves unless said bar section is disposed in a predetermined angular position relative to said side.

* * * * *